US011969066B1

(12) United States Patent
Zeng

(10) Patent No.: US 11,969,066 B1
(45) Date of Patent: Apr. 30, 2024

(54) CARD HOLDER WALLET

(71) Applicant: Shenzhen Wanhui Technology Innovation Co., Ltd., Shenzhen (CN)

(72) Inventor: Zheng Zeng, Shenzhen (CN)

( * ) Notice: Subject to any disclaimer, the term of this patent is extended or adjusted under 35 U.S.C. 154(b) by 0 days.

(21) Appl. No.: 18/486,033

(22) Filed: Oct. 12, 2023

(30) Foreign Application Priority Data

Jun. 13, 2023 (CN) ..... 202321505418.9
Sep. 5, 2023 (CN) ..... 202322409009.5

(51) Int. Cl.
*A45C 11/18* (2006.01)

(52) U.S. Cl.
CPC ..... *A45C 11/182* (2013.01)

(58) Field of Classification Search
CPC ..... A45C 11/182
See application file for complete search history.

(56) References Cited

U.S. PATENT DOCUMENTS 7,918,335 B1 * 4/2011 Kitchen ..... A45C 11/18 150/132
9,907,375 B1 * 3/2018 Kitchen ..... A45C 1/06
10,793,342 B2 * 10/2020 Minson ..... B65D 83/0829
2012/0228168 A1 * 9/2012 Kitchen ..... A45C 11/182 206/307
2018/0332936 A1 * 11/2018 Serman ..... A45C 11/182
2020/0178657 A1 * 6/2020 Van Geer ..... A45C 11/182
2021/0330045 A1 * 10/2021 Tran ..... A45C 1/06
2022/0225742 A1 * 7/2022 Tran ..... A45C 11/182

* cited by examiner

*Primary Examiner* — Sue A Weaver

(57) ABSTRACT

The present disclosure provides a card holder wallet. The card holder wallet includes: a shell and a flexible protective sleeve. The shell is provided with a first accommodating cavity and a first accommodating opening. The first accommodating opening is communicated with the first accommodating cavity. The first accommodating cavity is configured to accommodate a card. The protective sleeve is provided with a first portion and a second portion. The second portion and the first portion are rotatable. The first portion is connected to the shell. The second portion can rotate to cover the first accommodating opening. The protective sleeve is provided with a seventh accommodating cavity and a seventh accommodating opening. The seventh accommodating opening is communicated with the seventh accommodating cavity, and the seventh accommodating cavity is configured to accommodate money.

9 Claims, 12 Drawing Sheets

CARD HOLDER WALLET

CROSS-REFERENCE TO RELATED APPLICATIONS

The application claims priority of Chinese patent application CN2023215054189, filed on 2023/06/13, And CN2023224090095, filed on 2023/09/05 which is incorporated herein by reference in its entireties.

TECHNICAL FIELD

The present disclosure relates to the field of card holder wallets, and particularly, to a card holder wallet.

BACKGROUND

In modern life, people have to use various cards to some extent, such as various IC cards, bank cards, supermarket cards, shopping cards, and membership cards. Such a large number of cards are difficult to store and are easily confused. This often brings many unnecessary troubles. A card holder wallet is precisely designed to manage such a large number of cards, and can be referred to as a product of modern economy. In addition to storing cards, a traditional card holder wallet on the market usually has a clamp that can be used to clamp changes. However, using the clamp to clamp the changes often leads to loss of changes. Therefore, there is an urgent need to provide a card holder wallet on the market, which not only stores cards, but also stores changes. Occurrence of loss of changes is avoided.

SUMMARY

In order to overcome the shortcomings of the prior art, the present disclosure provides a card holder wallet, including:

a shell, wherein the shell is provided with a first accommodating cavity and a first accommodating opening; the first accommodating opening is communicated with the first accommodating cavity; the first accommodating cavity is configured to accommodate a card; further including a flexible protective sleeve, wherein the protective sleeve is provided with a first portion and a second portion; the second portion and the first portion are rotatable; the first portion is connected to the shell; the second portion rotates to cover the first accommodating opening; the protective sleeve is provided with a seventh accommodating cavity and a seventh accommodating opening; the seventh accommodating opening is communicated with the seventh accommodating cavity; and the seventh accommodating cavity is configured to accommodate money.

As the improvement of the present disclosure, the protective sleeve includes an inner layer and an outer layer; one side of the inner layer is connected to the shell, and the other side of the inner layer is connected to the outer layer; and the seventh accommodating cavity is formed between the inner layer and the outer layer.

As the improvement of the present disclosure, the inner layer is provided with a first bottom edge, a first top edge opposite to the first bottom edge, and a first left edge and a first right edge which are configured to connect the first bottom edge to the first top edge; the outer layer is provided with a second bottom edge, a second top edge opposite to the second bottom edge, and a second left edge and a second right edge which are configured to connect the second bottom edge to the second top edge; the first bottom edge is connected to the second top edge; the first left edge is connected to the second left edge, and the first right edge is connected to the second right edge, so that the inner layer is connected to the outer layer; the seventh accommodating cavity is formed between the inner layer and the outer layer; and the seventh accommodating opening is arranged between the first top edge and the second top edge.

As the improvement of the present disclosure, the shell further includes a first side wall opposite to the first accommodating opening, a second side wall, a third side wall opposite to the second side wall, a fourth side wall, and a fifth side wall opposite to the fourth side wall; and the first accommodating cavity is formed by encircling the first side wall, the second side wall, the third side wall, the fourth side wall, and the fifth side wall.

As the improvement of the present disclosure, the first portion is connected to an outer surface of the fourth side wall; and when the second portion rotates to cover an outer surface of the fifth side wall, the second portion is covered at the first accommodating opening.

As the improvement of the present disclosure, the seventh accommodating cavity extends from the first portion to the second portion, and the seventh accommodating opening extends from the first portion to the second portion.

As the improvement of the present disclosure, the second portion is provided with a magnetic suction member; the fifth side wall is a magnetic metal side wall; and when the second portion rotates to cover the outer surface of the fifth side wall, the magnetic suction member sucks the second portion to the outer surface of the fifth side wall.

As the improvement of the present disclosure, one side of the inner layer is connected to the fourth side wall of the shell.

As the improvement of the present disclosure, the card holder wallet further includes an elastic member, wherein the elastic member is arranged in the first accommodating cavity; the elastic member is configured to press and lock the card in the first accommodating cavity; the elastic member is arranged on an inner surface of the second side wall; the elastic member is configured to press and lock the card to the third side wall; the elastic member is a silica gel elastic member; the card holder wallet further includes a push device; the push device is connected to the shell; the push device is configured to push the card out of the first accommodating cavity via the first accommodating opening; the push device includes a push button, a push rod, and a push plate; the shell is provided with a sliding rail; the push button slides on the sliding rail; the push rod is connected to the push button to enable the push rod to slide with the push button; the push plate has a first end and a second end; a mounting port is arranged between the first end and the second end; a rotating shaft is arranged at a bottom of an inner wall of the first accommodating cavity; the mounting port of the push plate sleeves the rotating shaft; when the push button and push rod push the first end in a direction facing away from the first accommodating opening, the second end is pushed towards the first accommodating opening to push the card towards the first accommodating opening and out of the first accommodating cavity; the push device further includes an elastic reset member; one end of the elastic reset member is connected to the first accommodating cavity, and the other end of the elastic reset member is connected to one end of the push rod; when the push button and the other end of the push rod push the first end in the direction facing away from the first accommodating opening, the elastic reset member is stretched; an elastic reset force provided when the elastic reset member is stretched pulls the push rod and the push button to be reset towards the accommodating opening.

As the improvement of the present disclosure, the inner wall of the first accommodating cavity is further provided with a locating piece, and the elastic member is provided with a locating port; the locating port sleeves the locating piece; the elastic member is provided with several elastic bulges; and the elastic bulges press and lock the card in the first accommodating cavity.

As the improvement of the present disclosure, the card holder wallet further includes an elastic clamp; one end of the clamp is connected to the shell, and the other end of the clamp presses against the first portion to form a clamping space between the clamp and the first portion.

As the improvement of the present disclosure, the shell is further provided with a mounting slot; the card holder wallet further includes a first connecting piece; a side wall of the mounting slot is provided with a first mounting hole; one end of the clamp is provided with a second mounting hole; when one end of the clamp is plugged into the mounting slot, the first mounting hole is aligned with the second mounting hole, and the first connecting piece passes through the first mounting hole and the second mounting hole in sequence to fix one end of the clamp in the mounting slot.

As the improvement of the present disclosure, the fifth side wall is detachably connected to the first side wall, the second side wall, and the third side wall.

As the improvement of the present disclosure, the first portion includes a first sheet body and a second sheet body; an inner side of the first sheet body covers an outer surface of the fourth side wall; the second sheet body is connected to an outer side of the first sheet body; a second accommodating cavity is formed between an inner side of the second sheet body and the outer side of the first sheet body; an upper side of the second accommodating cavity is provided with a second accommodating opening; and a lower side of the second accommodating cavity is provided with a first notch.

As the improvement of the present disclosure, one end of the clamp is connected to the shell, and the other end of the clamp presses against the first sheet body, so as to form the clamping space between the clamp and the first portion.

As the improvement of the present disclosure, the push device further includes an elastic reset member; one end of the elastic reset member is connected to the first end, and the other end of the elastic reset member is connected to a bottom of the first accommodating cavity; when the push button and push rod push the first end in a direction facing away from the first accommodating opening, the elastic reset member is compressed; and an elastic reset force provided when the elastic reset member is compressed can push the first end, the push rod, and the push button to be reset towards the accommodating opening.

As the improvement of the present disclosure, the second portion includes a third sheet body, a fourth sheet body, a fifth sheet body, and a sixth sheet body. The third sheet body is rotatably connected to the first sheet body. The fourth sheet body is connected to an inner side of the third sheet body, and a third accommodating cavity is formed between the fourth sheet body and the inner side of the third sheet body. An upper side of the third accommodating cavity is provided with a third accommodating opening, and a lower side of the third accommodating cavity is provided with a second notch. The fifth sheet body is connected to an outer side of the third sheet body, and a fourth accommodating cavity is formed between an inner side of the fifth sheet body and an outer side of the third sheet body. An upper side of the fourth accommodating cavity is provided with a fourth accommodating opening. The sixth sheet body is connected to the outer side of the third sheet body, and a fifth accommodating cavity is formed between an inner side of the sixth sheet body and the outer side of the fifth sheet body. An upper side of the fifth accommodating cavity is provided with a fifth accommodating opening, and a lower side of the fifth accommodating cavity is provided with a third notch. The third notch, the fifth accommodating cavity, and the fourth accommodating cavity are communicated to each other.

As the improvement of the present disclosure, the card holder wallet further includes a seventh sheet body and an eighth sheet body. An inner side of the seventh sheet body is connected to the fourth side wall. The eighth sheet body is connected to an outer side of the seventh sheet body. A sixth accommodating cavity is formed between an inner side of the eighth sheet body and the outer side of the seventh sheet body. An upper side of the sixth accommodating cavity is provided with a sixth accommodating opening. The eighth sheet body is provided with a transparent region. A fourth notch is arranged on the transparent region. The fourth notch is communicated with the sixth accommodating cavity.

As the improvement of the present disclosure, the shell is further provided with a hanging port.

As the improvement of the present disclosure, the second end is provided with several steps, and heights of the steps increase gradually in sequence from the second end to the first end.

As the improvement of the present disclosure, a quantity of the several steps is at least 2.

Beneficial effects of the present disclosure are as follows: The present disclosure provides a card holder wallet. The card holder wallet includes: a shell, wherein the shell is provided with a first accommodating cavity and a first accommodating opening; the first accommodating opening is communicated with the first accommodating cavity; and the first accommodating cavity is configured to accommodate a card. The card holder wallet further includes a flexible protective sleeve. The protective sleeve is provided with a first portion and a second portion. The second portion and the first portion are rotatable. The first portion is connected to the shell. The second portion can rotate to cover the first accommodating opening. The protective sleeve is provided with a seventh accommodating cavity and a seventh accommodating opening. The seventh accommodating opening is communicated with the seventh accommodating cavity, and the seventh accommodating cavity is configured to accommodate money. Therefore, a user can store the card in the first accommodating cavity of the shell to achieve storage and management of the card. Furthermore, the user can also put paper money, coins, and other changes into the seventh accommodating cavity of the protective sleeve, which achieves a change storage function, so that the card holder wallet has the functions of both a card holder wallet and a purse. Further, since the second portion can rotate to cover the first accommodating opening, the protective sleeve with the purse function can also cover the first accommodating opening of the first accommodating cavity storing the card, which can effectively prevent the card from sliding out via the first accommodating opening.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
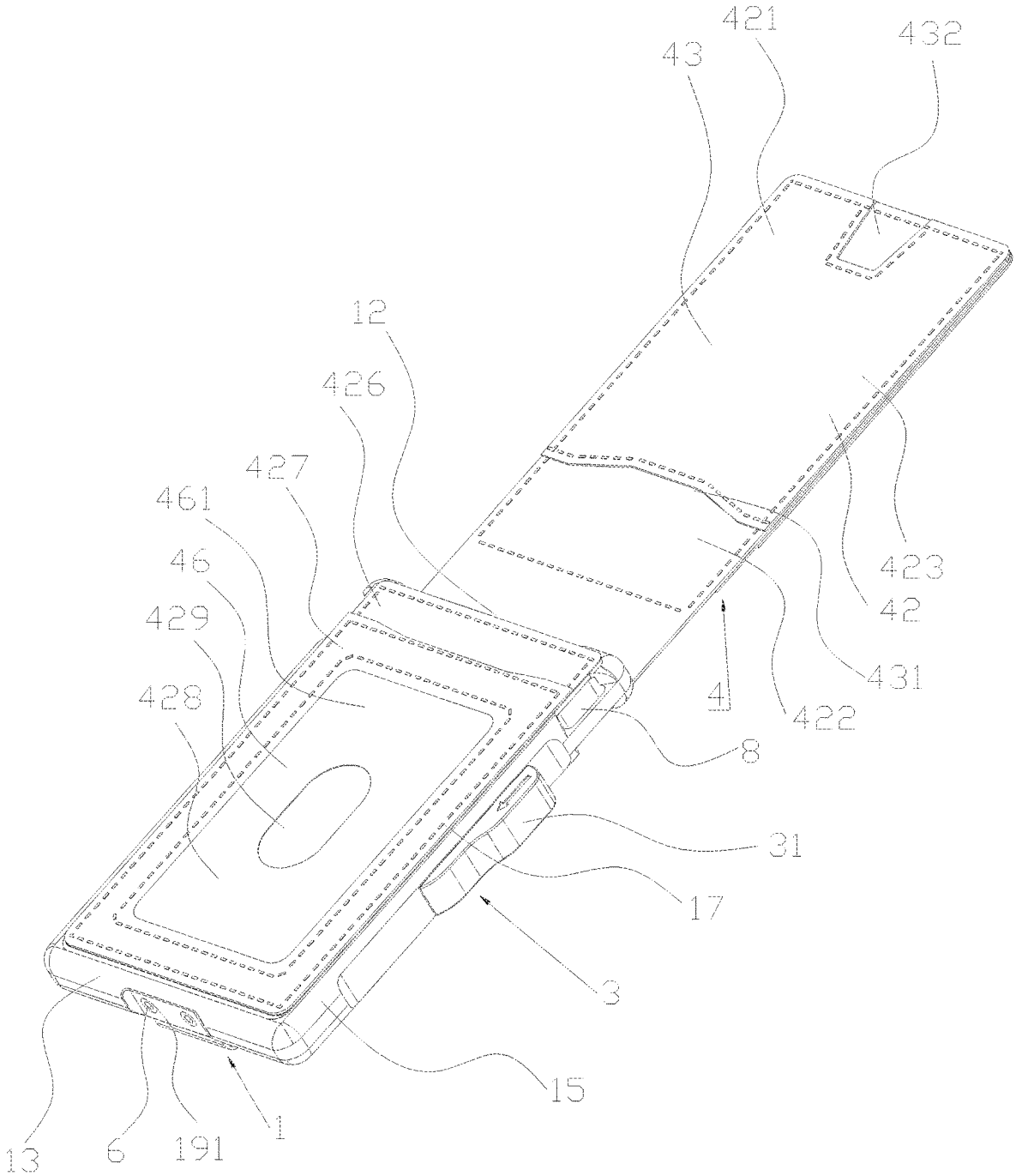
FIG. 1 is a schematic diagram of an entire structure of the present disclosure.
Figure 2:
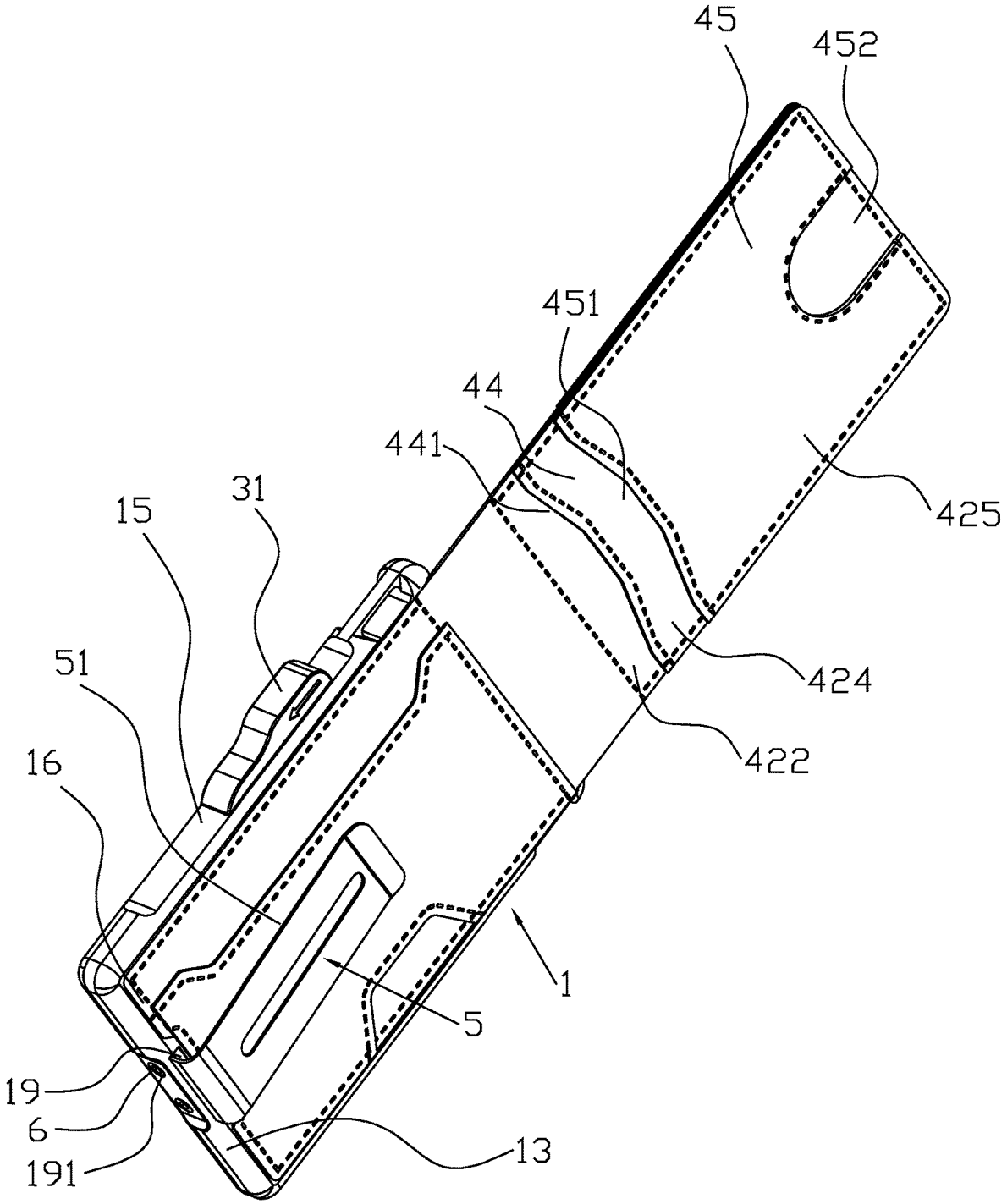
FIG. 2 is a schematic diagram of another entire structure of the present disclosure.
Figure 3:
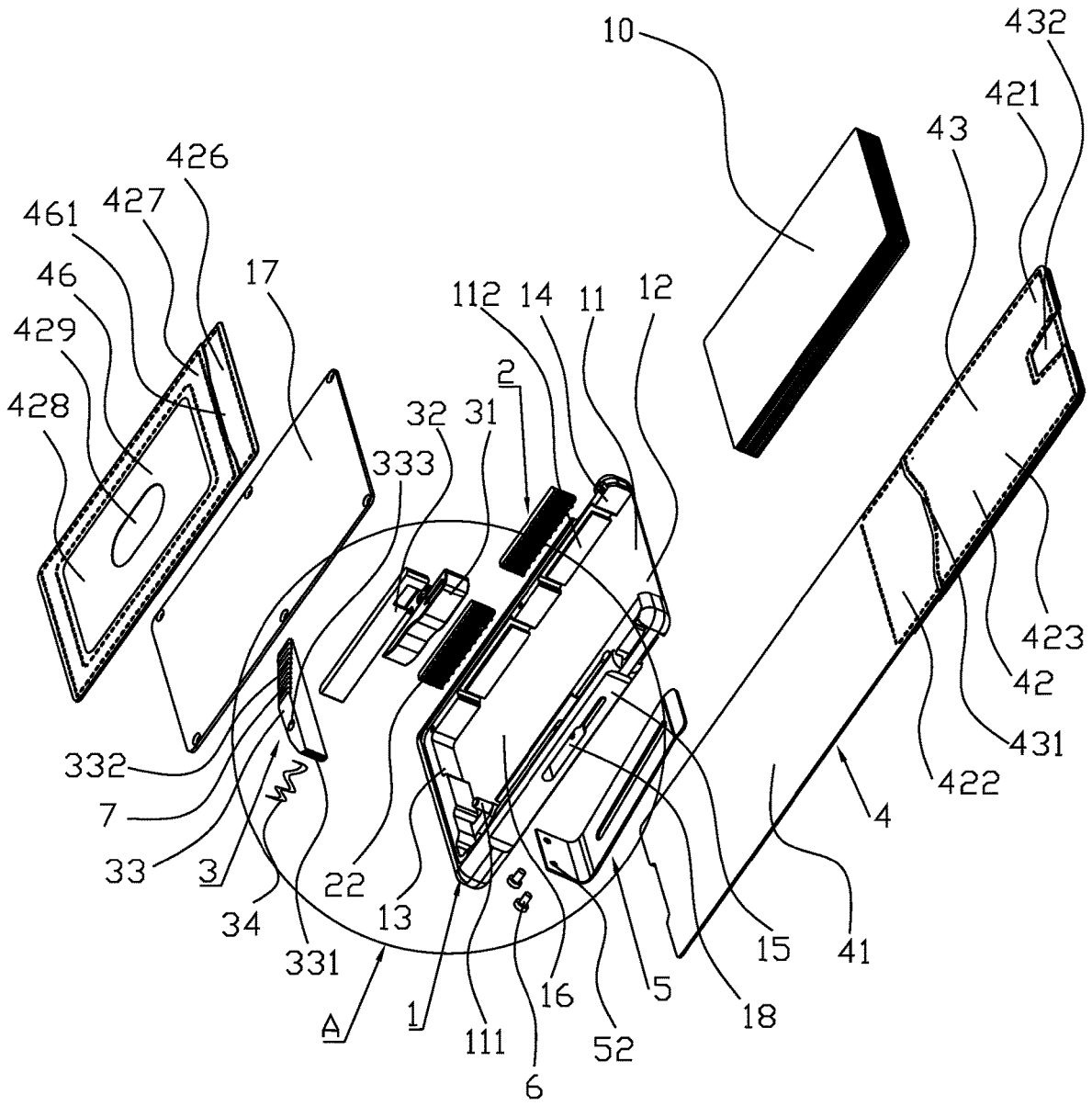
FIG. 3 is an exploded view of the present disclosure.
Figure 4:
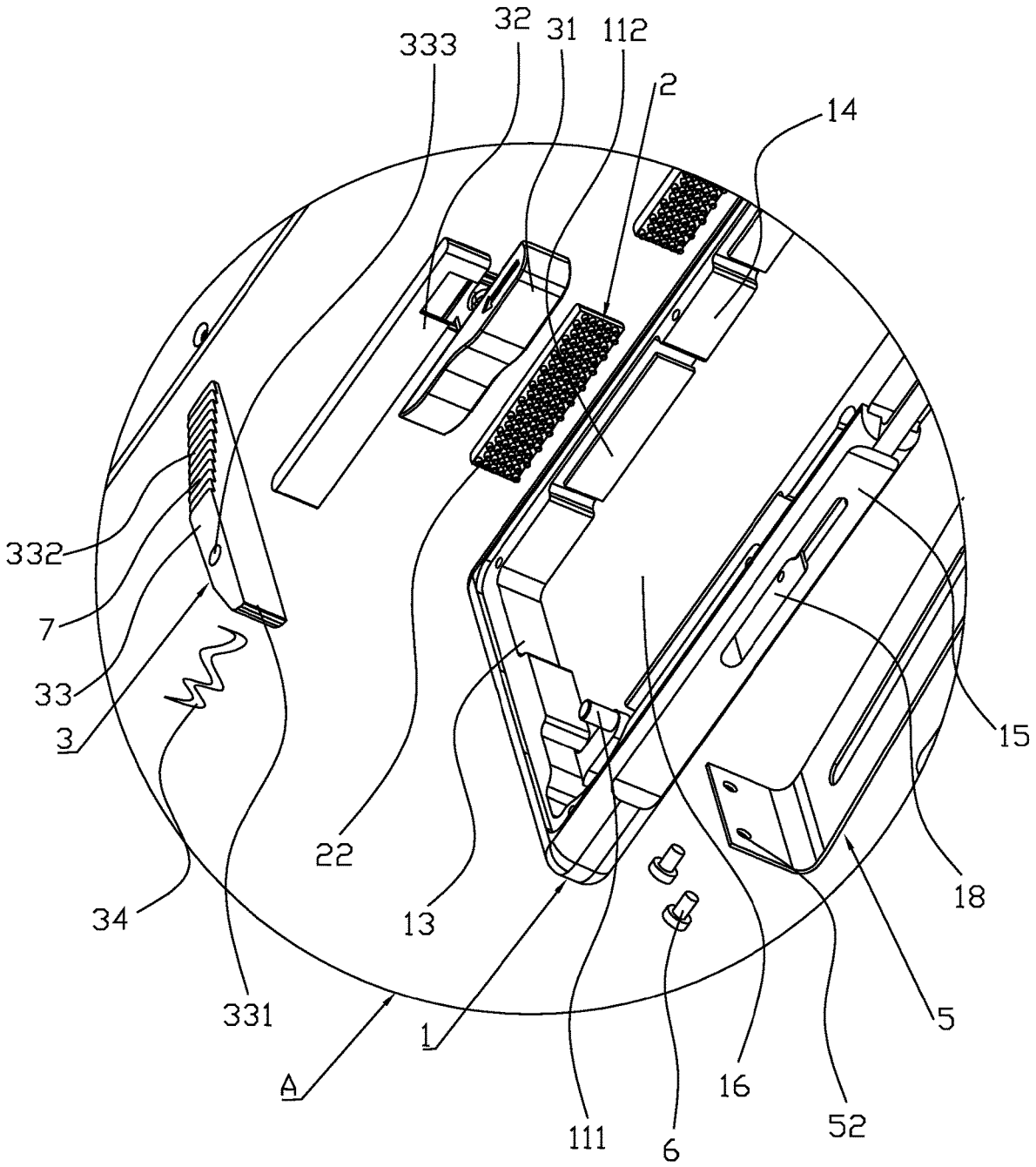
FIG. 4 is an enlarged view of the part A in FIG. 3.
Figure 5:
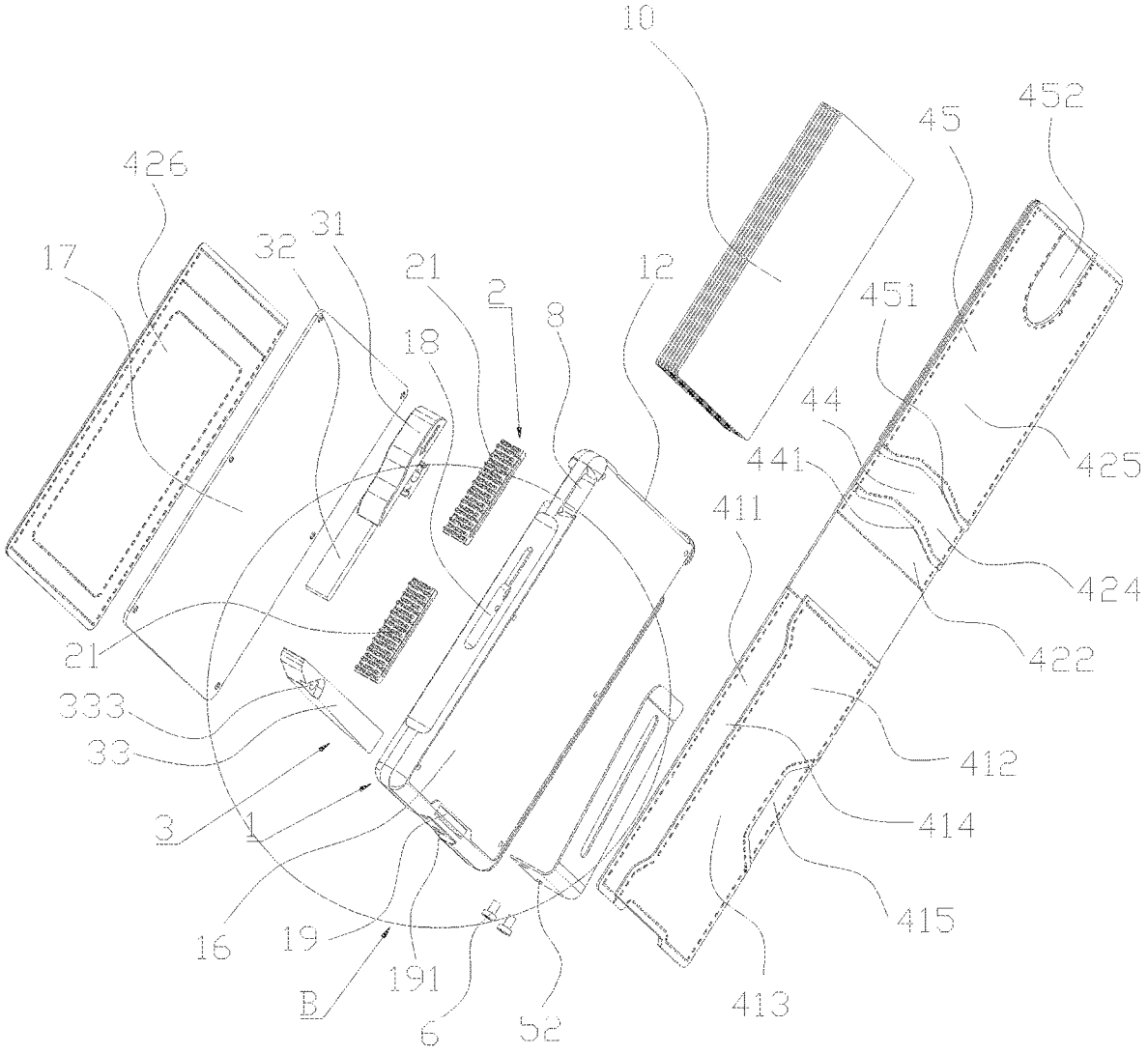
FIG. 5 is another exploded view of the present disclosure.
Figure 6:
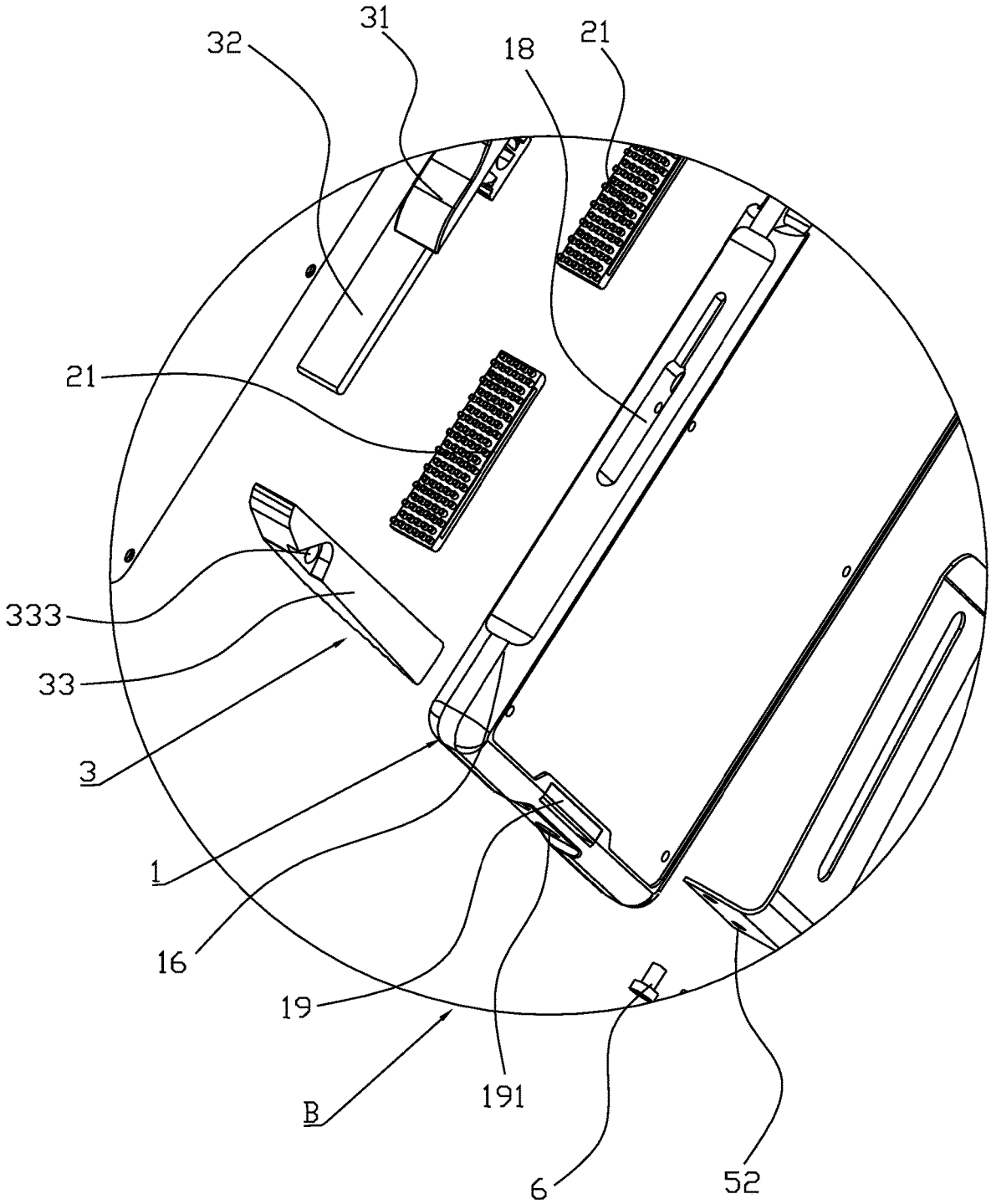
FIG. 6 is an enlarged view of the part B in FIG. 5.

Referring to FIG. 1 to FIG. 12, a card holder wallet includes: a shell 1, wherein the shell 1 is provided with a first accommodating cavity 11 and a first accommodating opening 12; the first accommodating opening 12 is communicated with the first accommodating cavity 11; and the first accommodating cavity 11 is configured to accommodate a card 10.

The card holder wallet further includes a flexible protective sleeve 4. The protective sleeve 4 is provided with a first portion 41 and a second portion 42. The second portion 42 and the first portion 41 are rotatable. The first portion 41 is connected to the shell 1. The second portion 42 can rotate to cover the first accommodating opening 12. The protective sleeve 4 is provided with a seventh accommodating cavity 47 and a seventh accommodating opening 471. The seventh accommodating opening 471 is communicated with the seventh accommodating cavity 47, and the seventh accommodating cavity 47 is configured to accommodate money.

Due to the above structure, the card holder wallet includes: a shell 1, wherein the shell 1 is provided with a first accommodating cavity 11 and a first accommodating opening 12; the first accommodating opening 12 is communicated with the first accommodating cavity 11; and the first accommodating cavity 11 is configured to accommodate a card 10. The card holder wallet further includes a flexible protective sleeve 4. The protective sleeve 4 is provided with a first portion 41 and a second portion 42. The second portion 42 and the first portion 41 are rotatable. The first portion 41 is connected to the shell 1. The second portion 42 can rotate to cover the first accommodating opening 12. The protective sleeve 4 is provided with a seventh accommodating cavity 47 and a seventh accommodating opening 471. The seventh accommodating opening 471 is communicated with the seventh accommodating cavity 47, and the seventh accommodating cavity 47 is configured to accommodate money. Therefore, a user can store the card in the first accommodating cavity of the shell to achieve storage and management of the card. Furthermore, the user can also put paper money, coins, and other changes into the seventh accommodating cavity of the protective sleeve, which achieves a change storage function, so that the card holder wallet has the functions of both a card holder wallet and a purse. Further, since the second portion 42 can rotate to cover the first accommodating opening 12, the protective sleeve with the purse function can also cover the first accommodating opening of the first accommodating cavity storing the card, which can effectively prevent the card from sliding out via the first accommodating opening.

Figure 11:
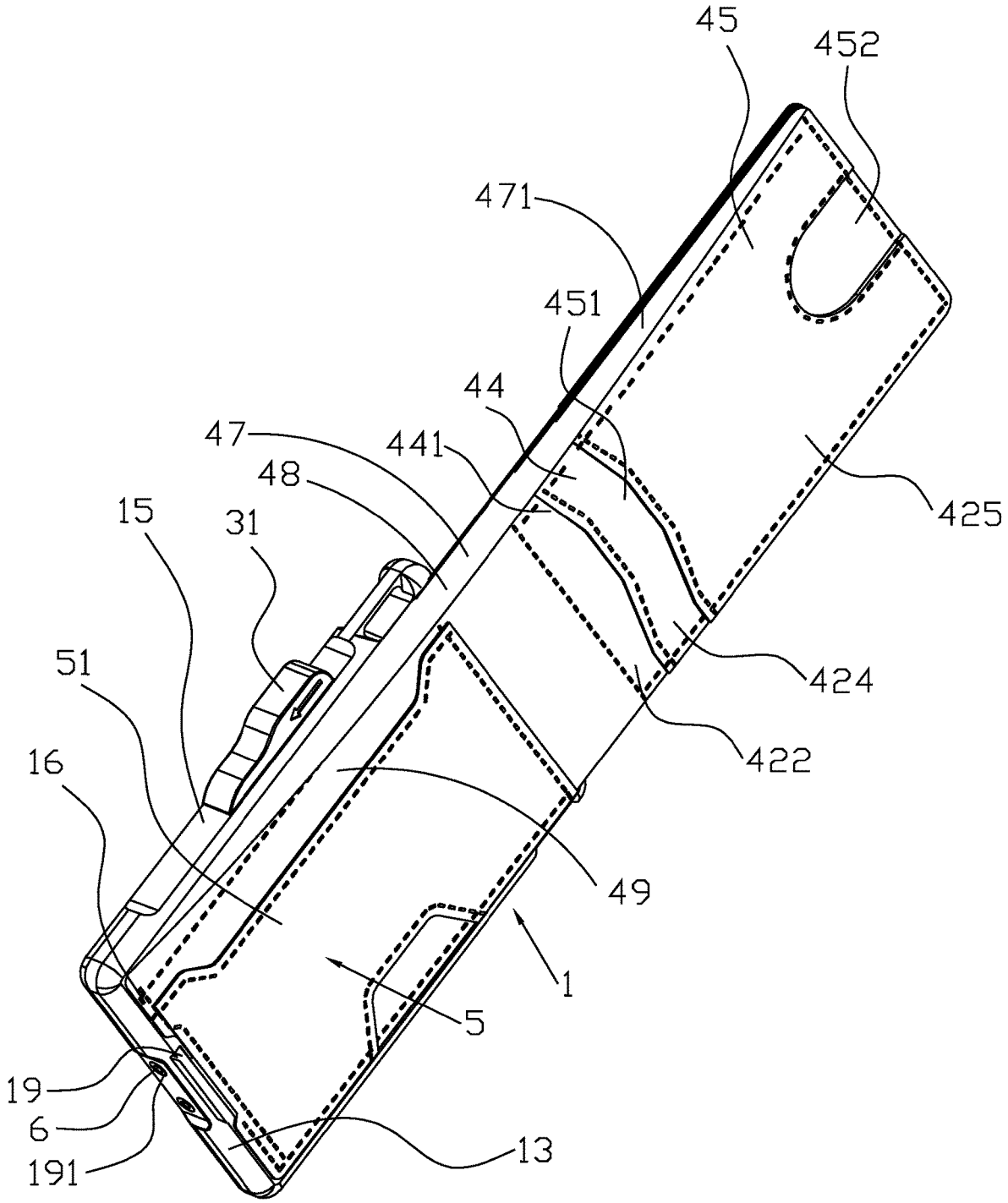
FIG. 11 is a schematic diagram of a seventh accommodating cavity of the present disclosure.
Figure 12:
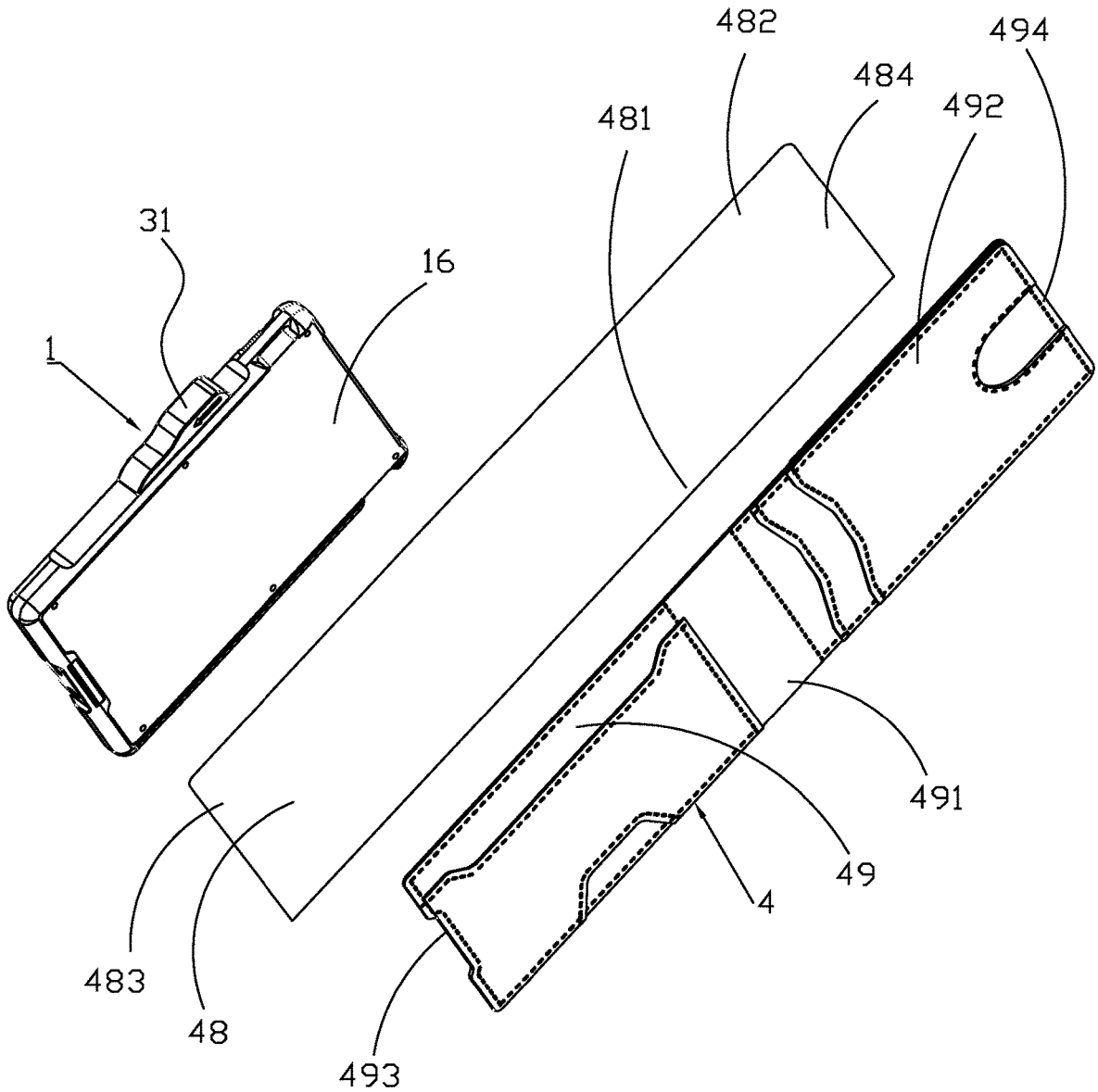
FIG. 12 is another exploded view of the present disclosure.

Referring to FIG. 11 and FIG. 12, the protective sleeve 4 includes an inner layer 48 and an outer layer 49; one side of the inner layer 48 is connected to the shell, and the other side of the inner layer 48 is connected to the outer layer 49; and the seventh accommodating cavity 47 is formed between the inner layer 48 and the outer layer 49. The inner layer 48 is provided with a first bottom edge 481, a first top edge 482 opposite to the first bottom edge 481, and a first left edge 483 and a first right edge 484 which are configured to connect the first bottom edge 481 to the first top edge 482; the outer layer 49 is provided with a second bottom edge 491, a second top edge 492 opposite to the second bottom edge 491, and a second left edge 493 and a second right edge 494 which are configured to connect the second bottom edge 491 to the second top edge 492; the first bottom edge 481 is connected to the second top edge 492; the first left edge 483 is connected to the second left edge 493, and the first right edge 484 is connected to the second right edge 494, so that the inner layer 48 is connected to the outer layer 49; the seventh accommodating cavity 47 is formed between the inner layer 48 and the outer layer 49; and the seventh accommodating opening 471 is arranged between the first top edge 482 and the second top edge 492. Through the above structure, the card holder wallet is reasonable in design and simple and compact in structure. The arrangement of the seventh accommodating cavity and the seventh accommodating opening is effectively completed, and it is convenient for the user to put changes into the seventh accommodating cavity via the seventh accommodating opening. Further, referring to FIG. 11 and FIG. 12, due to the seventh accommodating cavity for accommodating changes, an elastic clamp 5 for clamping changes can be selectively removed. In some embodiments, a clamp 5 can also be retained. A card or change can also be put into a clamping space 51 by pulling the clamp 5 while the seventh accommodating cavity is used to accommodate a change.

In this embodiment, the shell 1 further includes a first side wall 13 opposite to the first accommodating opening 12, a second side wall 14, a third side wall 15 opposite to the second side wall 14, a fourth side wall 16, and a fifth side wall 17 opposite to the fourth side wall 16. The first accommodating cavity 11 is formed by encircling the first side wall 13, the second side wall 14, the third side wall 15, the fourth side wall 16, and the fifth side wall 17.

The first portion 41 is connected to an outer surface of the fourth side wall 16. When the second portion 42 rotates to cover an outer surface of the fifth side wall 17, the second portion 42 covers the first accommodating opening 12. The second portion 42 is provided with a magnetic suction member 421. The fifth side wall 17 is a magnetic metal side wall. When the second portion 42 rotates to cover the outer surface of the fifth side wall 17, the magnetic suction member 421 sucks the second portion 42 to the outer surface of the fifth side wall 17. Through the above structure, due to the flexible protective sleeve, the user can hold the card holder wallet more comfortably. In addition, when the second portion 42 rotates to cover the outer surface of the fifth side wall 17, and the magnetic suction member 421 sucks the second portion 42 to the outer surface of the fifth side wall 17 to cover the first accommodating opening, which further prevents the card from falling off from the first accommodating opening.

In this embodiment, the seventh accommodating cavity 47 extends from the first portion to the second portion, and the seventh accommodating opening 471 extends from the first portion to the second portion. Through the above structure, the seventh accommodating cavity of the protective sleeve and the seventh accommodating opening have larger spaces, which can store more changes and make it easier for the user to put changes into the seventh accommodating cavity via the seventh accommodating opening.

In this embodiment, one side of the inner layer 48 is connected to the fourth side wall 16 of the shell. Through the above structure, the card holder wallet is reasonable in design and stable in connection, which effectively achieves the connection between the first portion of the protective sleeve and the shell.

In this embodiment, the card holder wallet further includes an elastic member 2. The elastic member 2 is arranged in the first accommodating cavity 11, and the elastic member 2 is configured to press and lock the card 10 in the first accommodating cavity 11. The elastic member is arranged on an inner surface of the second side wall. The elastic member is configured to press and lock the card to the third side wall. The elastic member 2 is a silica gel elastic member. Specifically, the elastic member 2 is provided with several elastic bulges 22. The elastic bulges 22 press and lock the card into the first accommodating cavity 11. Further, an inner wall of the first accommodating cavity 11 is further provided with a locating piece 112, and the elastic member 2 is provided with a locating port 21. The locating port 21 sleeves the locating piece 112. Through the above structure, when the card is put into the first accommodating cavity via the first accommodating opening, the elastic member located in the first accommodating cavity is pressed by two sides of the card. An elastic reset force generated when the elastic member is pressed presses the card into the first accommodating cavity, which can effectively prevent the card from sliding out of the first accommodating cavity via the first accommodating opening, causing card loss. When the user needs to take out the card, the user only needs to apply, to the card, a force greater than the elastic reset force generated when the elastic member is pressed, so as to take out the card from the first accommodating opening. Moreover, the mounting of the elastic member has been effectively completed. The elastic bulges on the silica gel elastic member can press and lock the card into the first accommodating cavity. Silica gel has better elastic performance, which can maintain elasticity for a long time. Compared to an ordinary spring and a clip, the silica gel elastic member has a longer service life and is softer. When the card is pressed into the first accommodating cavity, the card will not be damaged.

Figure 10:
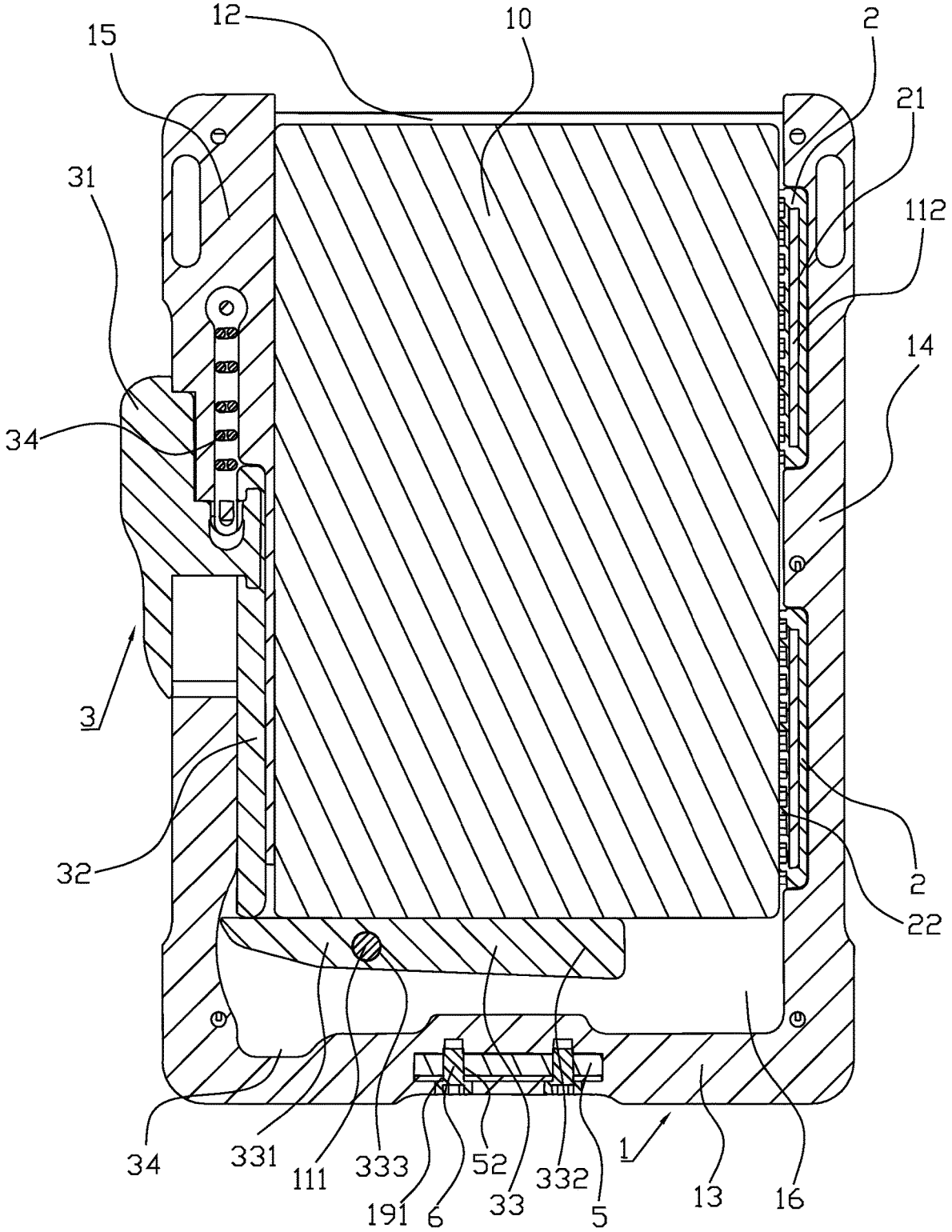
FIG. 10 is another sectional view cut away along an elastic member, a locating piece, a rotating shaft, and a push device.

In this embodiment, referring to FIG. 10, the card holder wallet further includes a push device 3. The push device 3 is connected to the shell 1. The push device 3 is configured to push the card out of the first accommodating cavity 11 via the first accommodating opening 12. The push device 3 includes a push button 31, a push rod 32, and a push plate 33; the shell 1 is provided with a sliding rail 18; the push button 31 can slide on the sliding rail 18; the push rod 32 is connected to the push button 31 to enable the push rod 32 to slide with the push button 31; the push plate 33 has a first end 331 and a second end 332; a mounting port 333 is arranged between the first end 331 and the second end 332; a rotating shaft 111 is arranged at a bottom of an inner wall of the first accommodating cavity 11; the mounting port 333 of the push plate 33 sleeves the rotating shaft 111; and when the push button 31 and push rod 32 push the first end 331 in a direction facing away from the first accommodating opening 12, the second end 332 is pushed towards the first accommodating opening 12 to push the card towards the first accommodating opening 12 and out of the first accommodating cavity 11. Specifically, the push device 3 further includes an elastic reset member 34; one end of the elastic reset member is connected to the first accommodating cavity 11, and the other end of the elastic reset member 34 is connected to one end of the push rod 32; when the push button 31 and the other end of the push rod 32 push the first end 331 in the direction facing away from the first accommodating opening 12, the elastic reset member 34 is stretched; and an elastic reset force provided when the elastic reset member 34 is stretched can pull the push rod 32 and the push button 31 to be reset towards the accommodating opening 12. Further, the second end 332 is provided with several steps 7, and heights of the steps 7 increase gradually in sequence from the second end 332 to the first end 331. Further, a quantity of the several steps 7 is at least 2. Through the above structure, the user can slide the push button to drive the push rod to push the first end in the direction facing away from the first accommodating opening, so that the second end is pushed towards the first accommodating opening. In this case, the elastic reset member is stretched, and the second end applies a push force to the card to push the card towards the first accommodating opening and out of the first accommodating cavity. Moreover, since the several steps are arranged on the second end, and the heights of the steps increase in sequence from the second end to the first end, the several steps with different heights can push the cards at the various height positions in the first accommodating cavity, and positions of contact points between the steps with the different heights and the cards are not on the same axial line. Therefore, when the steps on the second end push the plurality of cards in the first accommodating cavity, the plurality of cards are pushed at different distances and are staggered, making it easier for the user to accurately and quickly fetch a desired card. When the user releases the push button, the elastic reset force generated when the elastic reset member is stretched can pull the push button and push rod to be reset towards the first accommodating opening.

Figure 7:
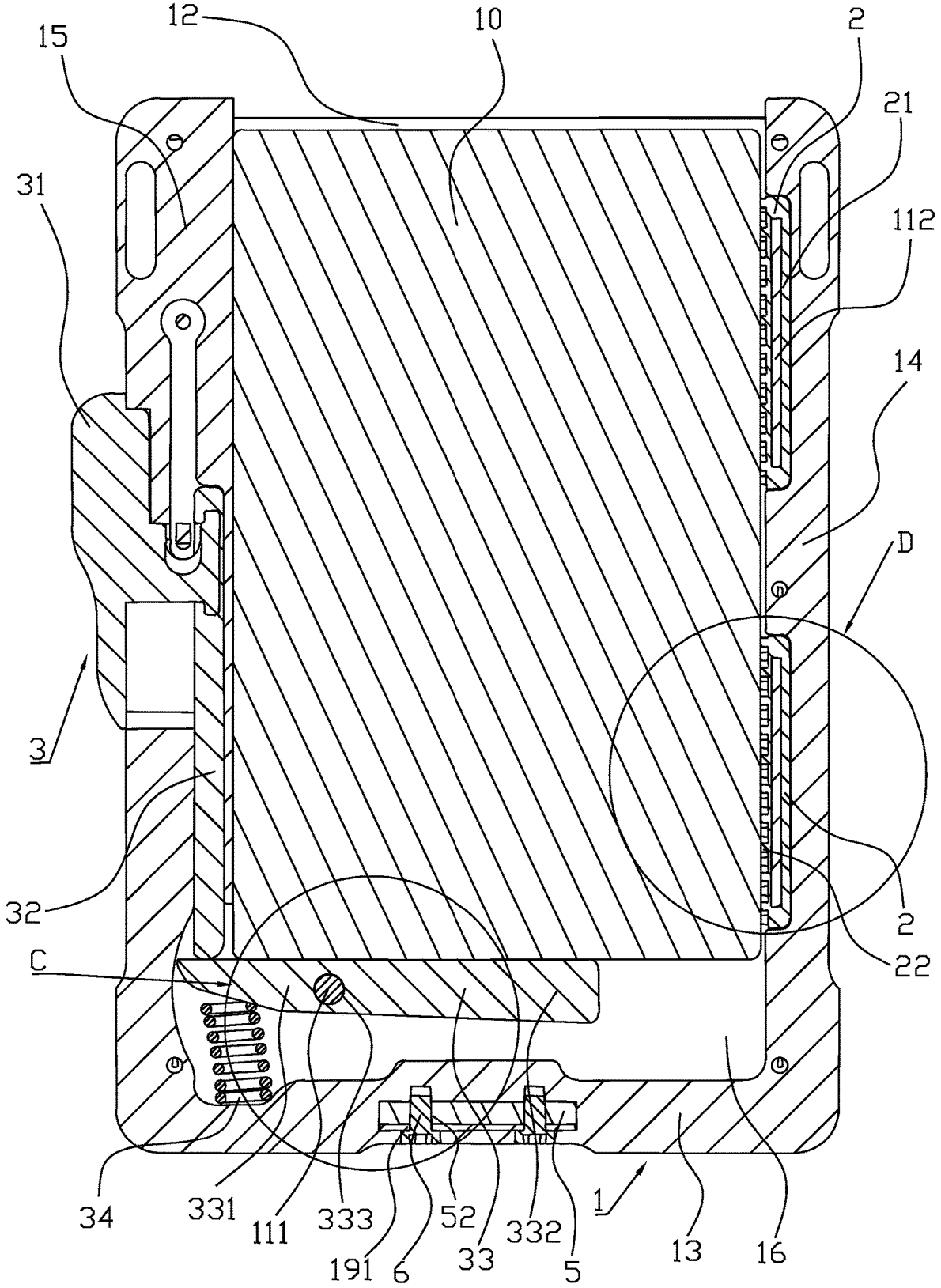
FIG. 7 is a sectional view cut away along an elastic member, a locating piece, a rotating shaft, and a push device.
Figure 8:
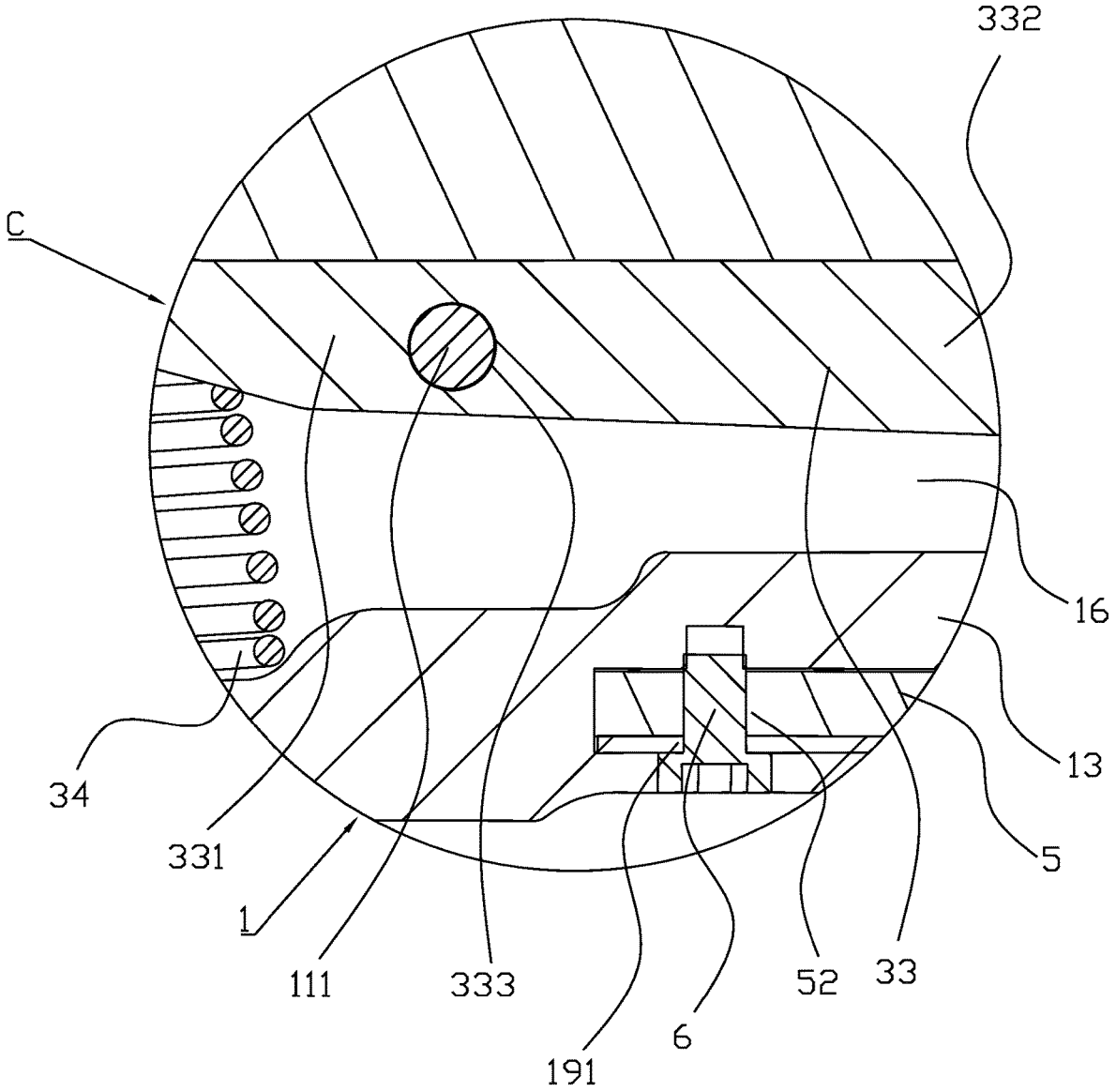
FIG. 8 is an enlarged view of the part C in FIG. 7.
Figure 9:
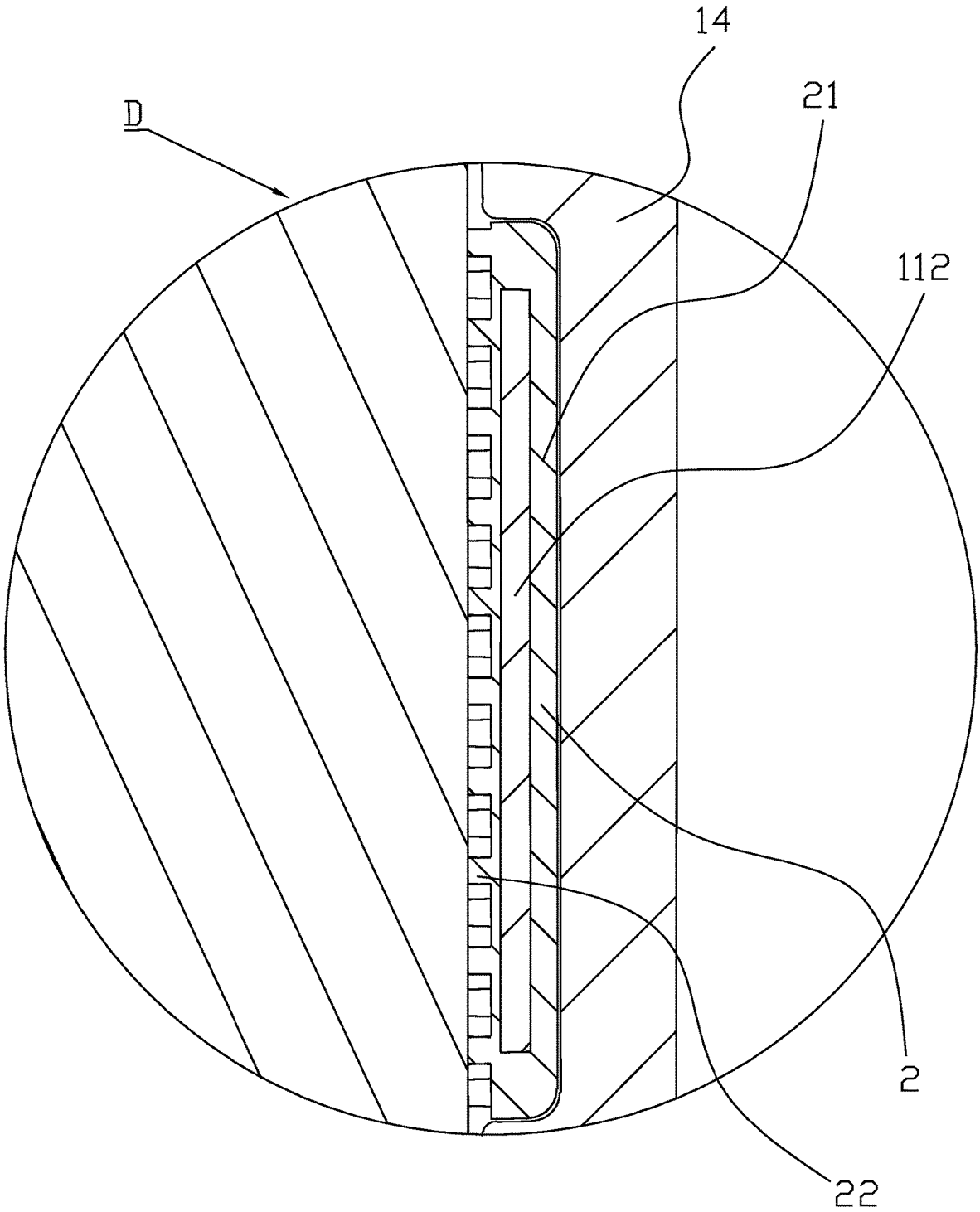
FIG. 9 is an enlarged view of the part D in FIG. 7.

Referring to FIG. 7, a mounting method of another elastic reset device is provided in this embodiment. The push device 3 further includes an elastic reset member 34; one end of the elastic reset member 34 is connected to the first end 331, and the other end of the elastic reset member 34 is connected to the bottom of the first accommodating cavity 11. When the push button 31 and the push rod 32 push the first end 331 in the direction facing away from the first accommodating opening 12, the elastic reset member 34 is compressed; and an elastic reset force provided when the elastic reset member 34 is compressed can push the first end 331, the push rod 32, and the push button 31 to be reset towards the accommodating opening 12.

The user can slide the push button to drive the push rod to push the first end in the direction facing away from the first accommodating opening, so that the second end is pushed towards the first accommodating opening. The second end applies, to the card, a push force greater than the elastic reset force generated when the elastic member is compressed, so as to push the card towards the first accommodating opening and out of the first accommodating cavity.

Moreover, since the several steps are arranged on the second end, and the heights of the steps increase in sequence from the second end to the first end, the several steps with different heights can push the cards at the various height positions in the first accommodating cavity, and positions of contact points between the steps with the different heights and the cards are not on the same axial line. Therefore, when the steps on the second end push the plurality of cards in the first accommodating cavity, the plurality of cards are pushed at different distances and are staggered, making it easier for the user to accurately and quickly fetch a desired card.

The sliding rail is arranged on the third side wall. Specifically, the locating piece 112 is arranged on an inner surface of the fourth or fifth side wall, and the locating piece is arranged on a left side of the fourth or fifth side wall. Specifically, the rotating shaft 111 is arranged on the inner surface of the fourth or fifth side wall, and the rotating shaft 111 is arranged on a lower side of the fourth or fifth side wall. Further, the first side wall is a front side wall of the shell; the second side wall is a left side wall of the shell; the third side wall is a right side wall of the shell; the fourth side wall is a lower side wall of the shell; and the fifth side wall is an upper side wall of the shell. Through the above structure, the mounting of the elastic member and the arrangement of the first accommodating cavity and the first accommodating opening are effectively achieved.

In this embodiment, the fifth side wall 17 is detachably connected to the first side wall 13, the second side wall 14, and the third side wall 15. Through the above structure, it is convenient for the user to detach the fifth side wall from the first side wall 13, the second side wall 14, and the third side wall, so as to mount the elastic member and the push device.

In this embodiment, the card holder wallet further includes a clamp 5. One end of the clamp 5 is connected to the shell 1, and the other end of the clamp 5 presses against the first portion 41 to form a clamping space 51 between the clamp 5 and the first portion 41. The shell is further provided with a mounting slot 19; the card holder wallet further includes a first connecting piece 6; a side wall of the mounting slot 19 is provided with a first mounting hole 191; one end of the clamp 5 is provided with a second mounting hole 52; when one end of the clamp is plugged into the mounting slot 19, the first mounting hole 191 is aligned with the second mounting hole 52, and the first connecting piece 6 passes through the first mounting hole 191 and the second mounting hole 52 in sequence to fix one end of the clamp 5 in the mounting slot 19. Through the above structure, the card holder wallet is simple in structure and stable in connection, and the mounting of the clamp is effectively achieved. A card or change can be put into the clamping space by pulling the clamp. Furthermore, the clamp can also be clamped onto a belt or a pocket through the clamping space.

In this embodiment, the first portion 41 includes a first sheet body 411 and a second sheet body 412; an inner side of the first sheet body 411 covers an outer surface of the fourth side wall 16; the second sheet body 412 is connected to an outer side of the first sheet body 411; a second accommodating cavity 413 is formed between an inner side of the second sheet body 412 and the outer side of the first sheet body 411; an upper side of the second accommodating cavity 413 is provided with a second accommodating opening 414; and a lower side of the second accommodating cavity 413 is provided with a first notch 415. Through the above structure, the mounting of the protective sleeve is effectively achieved. Cards can also be put into the second accommodating cavity, so that the card holder wallet can accommodate more cards. In addition, the cards can be pushed out of the second accommodating cavity via the second accommodating opening through the first notch arranged on the lower side of the second accommodating cavity, making it easier for the user to fetch the cards.

One end of the clamp 5 is connected to the shell 1, and the other end of the clamp 5 presses against the first sheet body 411 to form the clamping space 51 between the clamp 5 and the first portion 41. Through the above structure, since the other end of the clamp 5 presses against the second sheet body, the second sheet body can press the card into the second accommodating cavity to prevent the card from sliding out of the second accommodating cavity via the second accommodating opening.

In this embodiment, the second portion 42 includes a third sheet body 422, a fourth sheet body 423, a fifth sheet body 424, and a sixth sheet body 425. The third sheet body 422 is rotatably connected to the first sheet body 411. The fourth sheet body 423 is connected to an inner side of the third sheet body 422, and a third accommodating cavity 43 is formed between the fourth sheet body 423 and the inner side of the third sheet body 422. An upper side of the third accommodating cavity 43 is provided with a third accommodating opening 431, and a lower side of the third accommodating cavity 43 is provided with a second notch 432. The fifth sheet body 424 is connected to an outer side of the third sheet body 422, and a fourth accommodating cavity 44 is formed between an inner side of the fifth sheet body 424 and an outer side of the third sheet body 422. An upper side of the fourth accommodating cavity 44 is provided with a fourth accommodating opening 441. The sixth sheet body 425 is connected to the outer side of the third sheet body, and a fifth accommodating cavity 45 is formed between an inner side of the sixth sheet body 425 and the outer side of the fifth sheet body 424. An upper side of the fifth accommodating cavity 45 is provided with a fifth accommodating opening 451, and a lower side of the fifth accommodating cavity 45 is provided with a third notch 452. The third notch 452, the fifth accommodating cavity 45, and the fourth accommodating cavity 44 are communicated to each other. Through the above structure, the mounting of the protective sleeve is effectively achieved, and cards can also be put into the third, fourth, and fifth accommodating cavities, so that the card holder wallet can accommodate more cards. In addition, the cards can be pushed out of the third accommodating cavity via the third accommodating opening through the second notch, making it easier for the user to fetch the cards. Due to the third notch, the cards can be pushed out of the fourth accommodating cavity via the fourth accommodating opening and out of the fifth accommodating cavity via the fifth accommodating opening.

In this embodiment, the protective sleeve further includes a seventh sheet body 426 and an eighth sheet body 427. An inner side of the seventh sheet body 426 is connected to the fourth side wall 16. The eighth sheet body 427 is connected to an outer side of the seventh sheet body 426. A sixth accommodating cavity 46 is formed between an inner side of the eighth sheet body 427 and the outer side of the seventh sheet body 426. An upper side of the sixth accommodating cavity 46 is provided with a sixth accommodating opening 461. The eighth sheet body 427 is provided with a transparent region 428. A fourth notch 429 is arranged on the transparent region 428. The fourth notch 429 is communicated with the sixth accommodating cavity 46. Through the above structure, the mounting of the protective sleeve is effectively achieved. Cards can also be put into the sixth accommodating cavity, so that the card holder wallet can accommodate more cards. In addition, the cards can be pushed out of the sixth accommodating cavity via the sixth accommodating opening through the fourth notch, making it easier for the user to fetch the cards. Furthermore, the types of the cards placed in the sixth accommodating cavity can also be observed through the transparent region.

In this embodiment, the shell 1 is further provided with a hanging port 8. Through the above structure, a hanging rope can be mounted through the hanging port.

As described above, one or more embodiments are provided in conjunction with the detailed description, The specific implementation of the present disclosure is not confirmed to be limited to that the description is similar to or similar to the method, the structure and the like of the present disclosure, or a plurality of technical deductions or substitutions are made on the premise of the conception of the present disclosure to be regarded as the protection of the present disclosure.

What is claimed is:

1. A card holder wallet, comprising:

a shell, wherein the shell is provided with a first accommodating cavity and a first accommodating opening; the first accommodating opening is communicated with the first accommodating cavity; the first accommodating cavity is configured to accommodate a card; and a flexible protective sleeve, wherein the protective sleeve is provided with a first portion and a second portion; the second portion and the first portion are rotatable; the first portion is connected to the shell; the second portion rotates to cover the first accommodating opening; the protective sleeve is provided with a second accommodating cavity and second accommodating opening; the second accommodating opening is communicated with the second accommodating cavity; and the second accommodating cavity is configured to accommodate money;

wherein the protective sleeve comprises an inner layer and an outer layer; one side of the inner layer is connected to the shell, and the other side of the inner layer is connected to the outer layer;

wherein the inner layer is provided with a first bottom edge, a first top edge opposite to the first bottom edge, and a first left edge and a first right edge which are configured to connect the first bottom edge and the first top edge; the outer layer is provided with a second bottom edge, a second top edge opposite to the second bottom edge, and a second left edge and a second right edge which are configured to connect the second bottom edge to the second top edge; the first bottom edge is connected to the second top edge; the first left edge is connected to the second left edge, and the first right edge is connected to the second right edge, so that the inner layer is connected to the outer layer; the second accommodating cavity is formed between the inner layer and the outer layer; and the second accommodating opening is arranged between the first top edge and the second top edge.

2. The card holder wallet according to claim 1, wherein the shell further comprises a first side wall opposite to the first accommodating opening, a second side wall, a third side wall opposite to the second side wall, a fourth side wall, and a fifth side wall opposite to the fourth side wall; and the first accommodating cavity is formed by the first side wall, the second side wall, the third side wall, the fourth side wall, and the fifth side wall.

3. The card holder wallet according to claim 2, wherein the first portion is connected to an outer surface of the fourth side wall; and when the second portion rotates to cover an outer surface of the fifth side wall, the second portion covers the first accommodating opening.

4. The card holder wallet according to claim 3, wherein the second portion is provided with a magnetic suction member; the fifth side wall is a magnetic metal side wall; and when the second portion rotates to cover the outer surface of the fifth side wall, the magnetic suction member sucks the second portion to the outer surface of the fifth side wall.

5. The card holder wallet according to claim 2, wherein one side of the inner layer is connected to the fourth side wall of the shell.

6. The card holder wallet according to claim 2, further comprising an elastic member, wherein the elastic member is arranged in the first accommodating cavity; the elastic member is configured to press and lock the card in the first accommodating cavity; the elastic member is arranged on an inner surface of the second side wall; the elastic member is configured to press and lock the card to the third side wall; the elastic member is a silica gel elastic member; the card holder wallet further comprises a push device; the push device is connected to the shell; the push device is configured to push the card out of the first accommodating cavity via the first accommodating opening; the push device comprises a push button, a push rod, and a push plate; the shell is provided with a sliding rail; the push button slides on the sliding rail; the push rod is connected to the push button to enable the push rod to slide with the push button; the push plate has a first end and a second end; a mounting port is arranged between the first end and the second end; a rotating shaft is arranged at a bottom of an inner wall of the first accommodating cavity; the mounting port of the push plate sleeves the rotating shaft; when the push button and push rod push the first end in a direction facing away from the first accommodating opening, the second end is pushed towards the first accommodating opening to push the card towards the first accommodating opening and out of the first accommodating cavity; the push device further comprises an elastic reset member; one end of the elastic reset member is connected to the first accommodating cavity, and the other end of the elastic reset member is connected to one end of the push rod; when the push button and the other end of the push rod push the first end in the direction facing away from the first accommodating opening, the elastic reset member is stretched; an elastic reset force provided when the elastic reset member is stretched pulls the push rod and the push button to be reset towards the accommodating opening.

7. The card holder wallet according to claim 6, wherein the inner wall of the first accommodating cavity is further provided with a locating piece, and the elastic member is provided with a locating port; the locating port sleeves the locating piece; the elastic member is provided with several elastic bulges; and the elastic bulges press and lock the card in the first accommodating cavity.

8. The card holder wallet according to claim 1, wherein the second accommodating cavity extends from the first portion to the second portion, and the second accommodating opening extends from the first portion to the second portion.

9. A card holder wallet, comprising:

a shell, wherein the shell is provided with a first accommodating cavity and a first accommodating opening; the first accommodating opening is communicated with the first accommodating cavity; the first accommodating cavity is configured to accommodate a card; and a flexible protective sleeve, wherein the protective sleeve is provided with a first portion and a second portion; the second portion and the first portion are rotatable: the first portion is connected to the shell; the second portion rotates to cover the first accommodating opening; the protective sleeve is provided with a second accommodating cavity and second accommodating opening; the second accommodating opening is communicated with the second accommodating cavity; and the second accommodating cavity is configured to accommodate money;

wherein the second accommodating cavity extends from the first portion to the second portion, and the second accommodating opening extends from the first portion to the second portion.

* * * * *